United States Patent [19]

Whitaker, Jr.

[11] Patent Number: 4,674,208

[45] Date of Patent: Jun. 23, 1987

[54] BALLAST REMOVING APPARATUS

[75] Inventor: John B. Whitaker, Jr., Wetumpka, Ala.

[73] Assignee: Kershaw Manufacturing Company, Inc., Montgomery, Ala.

[21] Appl. No.: 846,022

[22] Filed: Mar. 31, 1986

[51] Int. Cl.[4] ..... E01B 27/04

[52] U.S. Cl. ..... 37/104; 171/16

[58] Field of Search ..... 37/97, 104, 105; 171/16

[56] References Cited

U.S. PATENT DOCUMENTS

| | | | |
|---|---|---|---|
| 1,625,864 | 4/1927 | Melin | 37/104 |
| 1,778,690 | 10/1930 | Scheuchzer | 37/104 |
| 2,778,128 | 1/1957 | Drouard et al. | 37/104 |
| 2,886,904 | 5/1959 | Kershaw | 37/104 |
| 2,924,030 | 2/1960 | Pedigo | 37/104 |
| 3,096,829 | 7/1963 | Plasser et al. | 171/16 |
| 3,356,157 | 12/1967 | Plasser et al. | 171/16 |
| 3,850,251 | 11/1974 | Plasser et al. | 171/16 |
| 3,967,395 | 7/1976 | Stewart | 171/16 |
| 3,967,396 | 7/1976 | Maisonneuve et al. | 37/104 |
| 4,108,076 | 8/1978 | Knape | 37/104 |
| 4,152,989 | 5/1979 | Theurer et al. | 37/104 |
| 4,342,165 | 8/1982 | Theurer et al. | 37/104 |
| 4,563,826 | 1/1986 | Whitaker, Jr. | 37/104 X |

FOREIGN PATENT DOCUMENTS

| | | | |
|---|---|---|---|
| 630833 | 3/1963 | Belgium | 37/104 |

*Primary Examiner*—E. H. Eickholt

*Attorney, Agent, or Firm*—Jennings, Carter, Thompson & Veal

[57] ABSTRACT

An apparatus for removing ballast utilizes a ditcher wheel to remove ballast from along the side of a railroad track. An undercutter is pivotally mounted to the frame of the ditcher wheel rearwardly thereof and is also pivotal about a vertical axis such that the undercutter may be placed beneath the track while supported by the ditcher wheel. A portion of the undercutter is aligned parallel to the track proximal and rearwardly of the ditcher wheel and serves to urge the ballast removed by the undercutter into the path of the ditcher wheel for removal.

8 Claims, 4 Drawing Figures

BALLAST REMOVING APPARATUS

FIELD OF THE INVENTION

The present invention relates to the field of railroad maintenance and more particularly to the removal of ballast from beneath existing railroad tracks.

Numerous devices have been devised to remove the ballast beneath existing railroad tracks including those disclosed in U.S. Pat. Nos. 1,625,864; 1,778,690; 2,886,904; 3,096,829; 3,356,177; 3,967,396; and 4,563,826. In each of these an undercutter, either pivotal or fixed, is used to scrape ballast beneath the tracks to the outside of the roadbed. There the ballast is picked up by a trailing elevator means or is carried in a conveyor to a leading elevator means for removal. None of the known machines are totally satisfactory in terms of economy, efficiency and simplicity, particularly with respect to the ability of the operator to monitor his work.

SUMMARY OF THE INVENTION

It is the object of the present invention to provide an apparatus for removing ballast from beneath an existing railroad track utilizing a minimum amount of labor for installation beneath the track and utilizing a minimal physical space on a carriage.

To accomplish this object I have combined a conventionally driven ditcher wheel with an undercutter which removes ballast from under the track and introduces this ballast to the rear of the ditcher wheel without any intermediate components. This undercutter, unlike conventional undercutters, utilizes a toothed and paddled chain which travels counterclockwise around a horizontally disposed chain guide. Conventional undercutters utilize a clockwise movement of the chain about the chain guide thereby urging the ballast outwardly along the forward face of the undercutter. My undercutter is generally triangular in shape and moves the ballast inwardly along the forward face of the undercutter, outwardly along the rear face of the undercutter, and forwardly along the lateral face of the undercutter such that ballast is discharged thereby proximal the lower rear periphery of the ditcher wheel. As the ballast is discharged by the undercutter, it is scooped up by the ditcher wheel and removed from alongside the track.

BRIEF DESCRIPTION OF THE DRAWINGS

Apparatus embodying features of my invention are depicted in the accompanying drawings, which form a portion of this application, and wherein.

DESCRIPTION OF A PREFERRED EMBODIMENT

Figure 1:
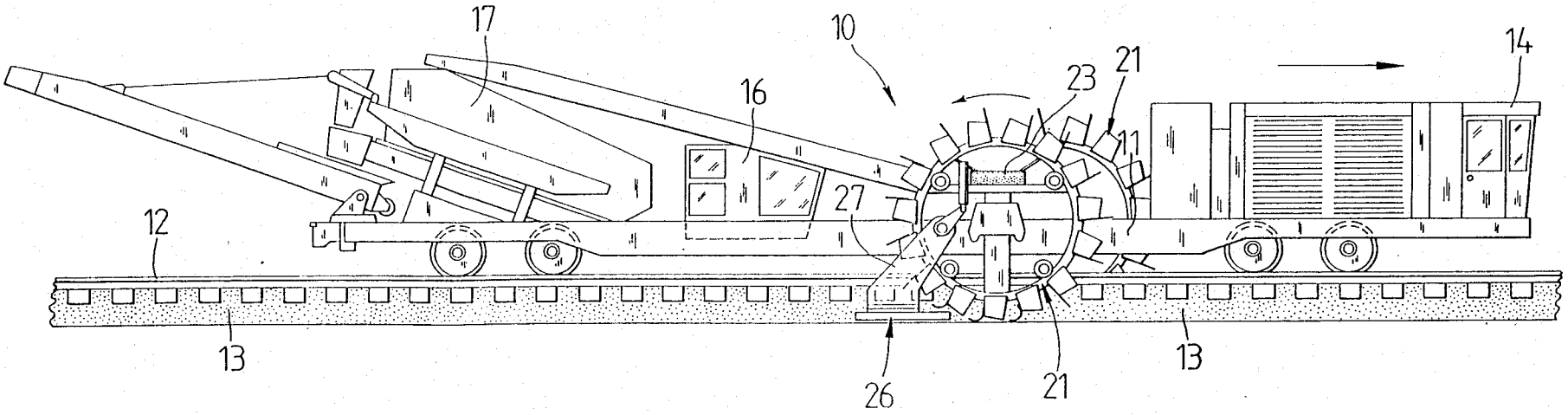
FIG. 1 is a pictorial representation in side elevation of my invention mounted on a carriage for use with a ballast cleaner.

Referring to FIG. 1, my invention denoted at 10 is a form of ballast removing apparatus which may be used in conjunction with a carriage 11 supported on a railroad track 12 underlain by a bed of ballast 13. A driver's compartment 14 and an operator's compartment 16 are provided atop the carriage 11 as is a ballast cleaner 17. It will be appreciated that the aforesaid elements are shown in the drawings to depict a particular application of my invention; however only the carriage 11 and operator's compartment 16 would be retained in other applications but are not necessarily considered part of the invention.

Figures 2, 4:
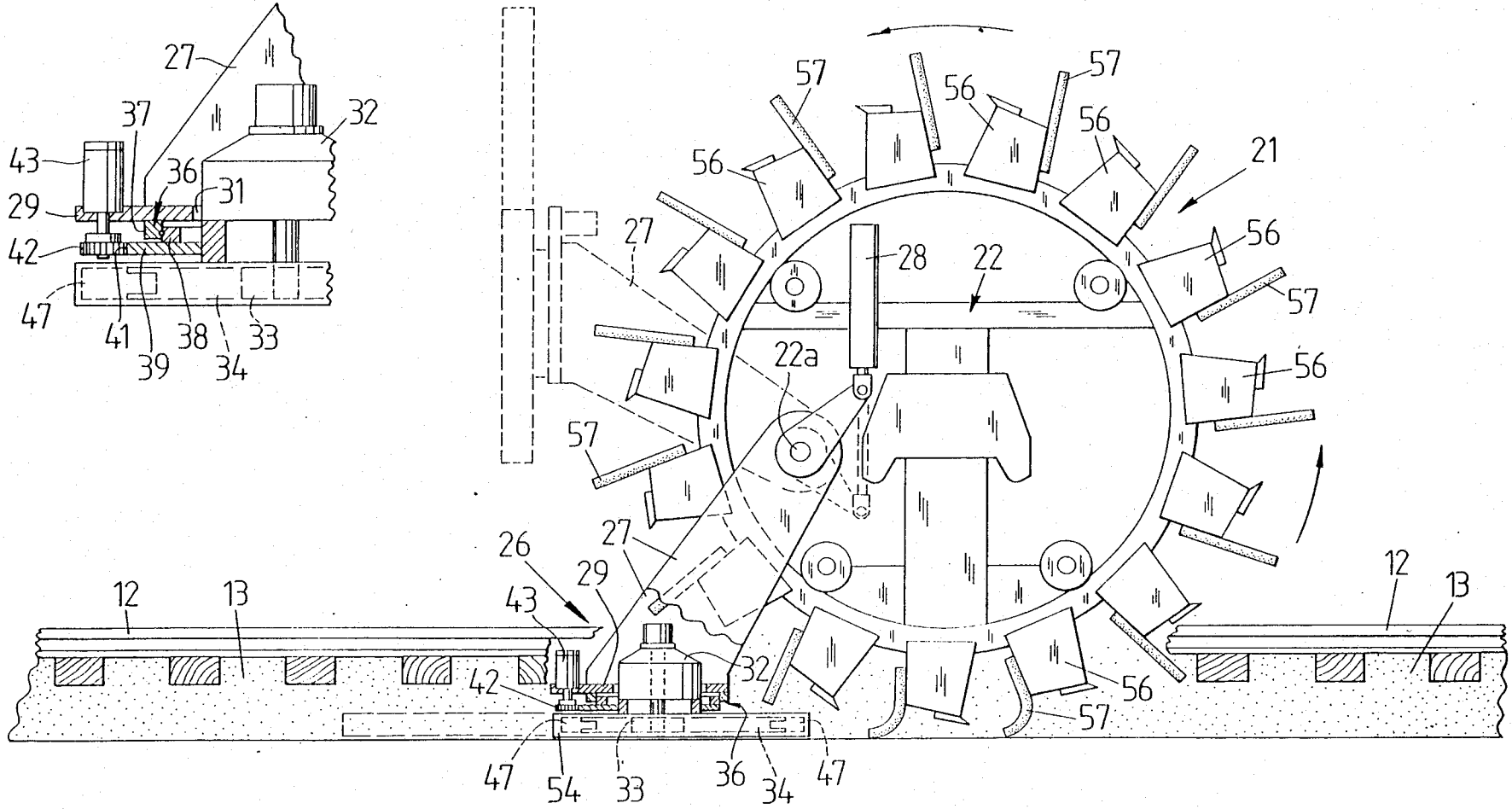
FIG. 2 is a diagrammatic side elevational view of my invention partially in section and with parts being omitted for the sake of clarity.
FIG. 4 is a fragmental side elevation partially in section showing the means for rotating the undercutter to its work position.
Figure 3:
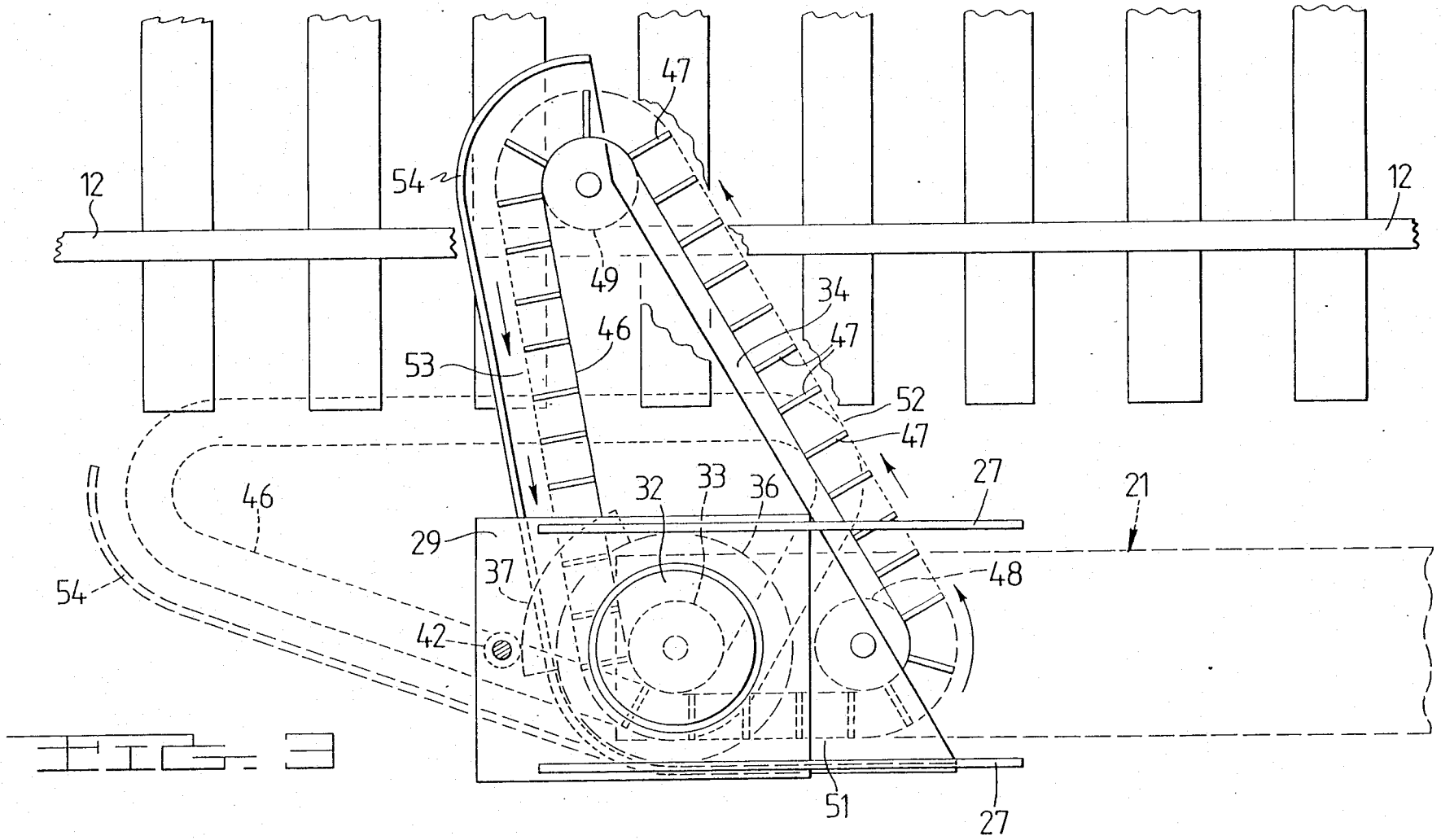
FIG. 3 is a plan view of my invention.

The ballast removing apparatus is more clearly depicted in FIGS. 2 and 3. A conventional ditcher wheel 21 is mounted on a suitable frame 22 and is conventionally movable vertically and laterally with respect to the carriage 11 which supports the frame 22. A cross conveyor 23 is positioned to receive ballast from the ditcher wheel 21 as is well known. Ditcher wheels, of the type herein employed, may excavate a trench at a rate of up to 5,000 feet per hour when operated at full capacity. Therefore, when the ditcher wheel's forward motion is less than 5,000 feet per minute, the ditcher wheel 21 is not fully loaded and is capable of delivering more ballast to the cross conveyor 23 than the ditcher wheel 21 is actually removing. The apparatus disclosed in my U.S. Pat. No. 4,563,826 took advantage of this by placing an auxiliary conveyor rearwardly of a ditcher wheel to transport ballast from a conventional undercutter to the ditchers. While the apparatus is operable, it is somewhat cumbersome and does not make optimum utilization of the space available on the carriage.

The present invention utilizes a pivotally mounted undercutter assembly 26 operatively connected to the frame 22 and supported thereby for concomitant lateral and vertical motion with the ditcher wheel 21. The undercutter assembly 26 includes a pair of bracket arms 27 which are pivotally mounted to the frame 22 as at **22*a* and are connected to a hydraulic cylinder 28, also carried by frame 22, such that the bracket arms 27 pivot responsive to the actuation of the cylinder 28 to selectively position the undercutter assembly at a raised storage or travel position, as shown in dotted lines in FIG. 2, and at a lowered position. The lower ends of the bracket arms 27 terminate at and are secured to a plate 29 which has an aperture 31 therethrough. A hydraulic motor 32 is positioned within the aperture 31 to drive a main sprocket 33. The main sprocket 33 is carried by a chain guide 34 which is rigidly attached to the motor 32 and is attached to plate 29 by means of a slewing ring 36, which has one race 37 affixed to plate 29 and a movable race 38 connected to the motor 32 and chain guide 34. The movable race 38 has an extension 39, the outer periphery 41 of which is arcuate and measures over 60° in arc. This arcuate outer periphery 41 is engaged by a spur gear 42 driven by an auxiliary motor 43 mounted to plate 29. The spur gear 42 causes the movable race 38 and the chain guide 34 to rotate about an axis perpendicular to the plate 29 such that the chain guide 34** may be oriented at a work position and at an inoperable position.

The chain guide 34 is generally triangular in shape and defines a path for an undercutter chain 46 which carries a plurality of paddle-like teeth 47. The chain 46 is driven by motor 32 through the main sprocket 33 and is engaged by a pair of turning sprockets 48 and 49 at the corners of the triangular chain guide 34. Thus the chain 46 and the chain guide 34 form a lateral face 51 intermediate the main sprocket 33 and turning sprocket 48, a forward face 52 intermediate turning sprockets 48 and 49 forming an acute angle with the lateral force at the turning sprocket 48, and a rearward face 53 turning sprocket 49 and main sprocket 33, forming an acute angle with the forward face 52 at the turning sprocket 49. A housing 54 extends outwardly from the chain guide 34 adjacent turning sprocket 49 along and in spaced relation to rearward face 53 and lateral face 51 thereby forming a conveying housing between the chain guide 34 and the housing 54, through which the teeth 47 and ballast carried thereby travel. Housing 54 is open at the top to admit ballast to the chain area.

When the chain guide 34 is oriented at the work position, the lateral face 51 is aligned parallel to the track 12 and turning sprocket 48 is immediately behind and below the ditcher wheel 21. The ditcher wheel 21 is provided with digging buckets 56 which pass proximal the teeth 47 at a distance of about one and one-half inches as the teeth 47 traverse the sprocket 48. A plurality of resilient sweeper elements 57 are attached to the back of each bucket 56 and extend substantially radially of the ditcher wheel 21 so as to sweep across the path of teeth 47 as the associated bucket 56 passes proximal turning sprocket 48.

In operation, the ditcher wheel 21 is conventionally positioned relative to the track 12 and excavates a trench in the ballast alongside the track 12. When the trench is sufficiently formed, hydraulic cylinder 28 lowers the undercutter assembly from the upper travel position to a position alongside the track, as shown in FIG. 2. Motor 32 then drives the chain 46 about the chain guide 34 and the spur gear 42 driven by motor 43 causes the chain guide 34 to rotate from the inoperable position alongside the track to the work position beneath the track, as shown in FIG. 3. Chain 46 moves counterclockwise about the chain guides 34 as viewed from above; thus the chain moves inwardly of the track 12 along the forward face 52 with the teeth 47 scarifying the ballast from beneath the track 12 during this inward motion. The scarified ballast is carried into the conveying housing 54 proximal the turning sprocket 49 and is constrained to move along this housing to turning sprocket 48. With the motor 32 operating at 246 rpm, the chain 46 has a linear velocity of 804 feet per minute, thus the ballast exits the conveying housing proximal turning sprocket 48 with a great deal of momentum and continues its generally forward motion into the path of the ditcher wheel's buckets 56, which remove the ballast and continue the trenching operation. In the unlikely event that ballast begins accumulating forward of the teeth 47 yet rearwardly of the ditcher wheel 21, the sweeper elements 57 will urge the accumulated ballast forward into the path of the buckets 56.

From the foregoing it may be seen that an operator located at the operator's cab 16 can easily see and control the operation and position of the entire ballast removing apparatus 10, which, although large, is quite compactly located on the carriage 11 when compared to prior arrangements. It will also be appreciated that the unique arrangement of the undercutter assembly allows the ballast to be positively moved forwardly along the lateral face 51 so that the ballast is delivered to the ditcher wheel 21 without the need for any additional components which would tend to make the apparatus more cumbersome and complex.

While I have shown my invention in but one form, it will be obvious to those skilled in the art that it is not so limited, but is susceptible of various changes and modifications without departing from the spirit thereof.

What I claim is:

1. Apparatus for excavating ballast from along a railroad track comprising:

(a) a ditcher wheel positioned to excavate ballast alongside said track; and (b) an undercutter pivotally supported on said ditcher wheel for selective movement about a horizontal axis to an upper travel position and a lower inoperable position alongside said track, said undercutter also being selectively rotatable about a vertical axis while in said lower position to a work position beneath said track and to said inoperable position and having at least three faces including a face aligned parallel to said track rearwardly of and proximal said ditcher wheel while in said work position, such that ballast removed by said undercutter is discharged into the path of said ditcher wheel.

2. Apparatus as defined in claim 1 wherein said undercutter comprises:

(a) a generally triangular chain guide forming a lateral face parallel to said track in said work position, a forward face extending rearwardly and inwardly of said ditcher wheel and forming an acute angle with said lateral face, and a rearward face connecting said first and second faces and forming an acute angle with said forward face;

(b) a toothed chain extending about the periphery of said chain guide along said faces; and (c) means for driving said chain such that the portion thereof along said lateral force moves toward said ditcher wheel.

3. Apparatus as defined in claim 2 wherein said toothed chain includes paddle-like teeth extending generally perpendicular to said faces.

4. Apparatus as defined in claim 2 further comprising a plurality of resilient sweeper elements carried by said ditcher wheel and positioned to pass forwardly of said undercutter as said ditcher wheels rotate such that loose ballast is urged toward said ditcher wheel thereby.

5. In an apparatus for removing ballast from along a railroad track including a movable frame supported by said track and a driven ditcher wheel mounted for rotation on said frame such that said wheel removes ballast adjacent the ends of said ties, the improvement comprising:

(a) an undercutter including a chain guide and a driven digging chain carried peripherally about said chain guide with a portion of said chain rearwardly of and proximal the lower periphery of said ditcher wheel being driven parallel to said track such that ballast removed by said undercutter is discharged into the path of said ditcher wheel; and (b) means for supporting said undercutter from said ditcher wheel operable to position said undercutter proximal the lower periphery of said ditcher wheel such that said undercutter may remove ballast from beneath said track and to position said undercutter at an elevation above said frame when said undercutter is not in use.

6. The improvement as defined in claim 5 further comprising means for selectively rotating said undercutter about a vertical axis to a work position and an inoperable position.

7. The improvement as defined in claim 5 wherein said chain guide is generally triangular in shape with sprockets mounted at the corners thereof for turning said chain about said corners, and with said triangular shape including a leading face extending beneath said track along which said chain removes said ballast, a return face extending generally perpendicular to said track, and a discharge face extending parallel to said track and positioned rearwardly of and proximal the lower periphery of said ditcher wheel.

8. The improvement as defined in claim 7 further comprising a conveying housing extending along said return face and said discharge face of said chain guide and spaced therefrom to enable ballast removed along said leading face to be carried along said return face and said discharge face by said chain.

* * * * *